United States Patent [19]

Onoda et al.

[11] Patent Number: 4,561,195

[45] Date of Patent: Dec. 31, 1985

[54] MIDSOLE ASSEMBLY FOR AN ATHLETIC SHOE

[75] Inventors: Kenji Onoda, Kajiwara; Yukio Kawasima, Akashi, both of Japan

[73] Assignee: Mizuno Corporation, Osaka, Japan

[21] Appl. No.: 522,700

[22] Filed: Aug. 12, 1983

[30] Foreign Application Priority Data

Dec. 28, 1982 [JP] Japan ..... 57-197592[U]

[51] Int. Cl.[4] ..... A43B 13/12

[52] U.S. Cl. ..... 36/30 R; 36/28; 36/31; 36/32 R

[58] Field of Search ..... 36/30 R, 28, 29, 31, 36/102, 32 R, 25 R, 114

[56] References Cited

U.S. PATENT DOCUMENTS

| | | | |
|---|---|---|---|
| 1,255,107 | 1/1918 | Redfern | 36/30 R |
| 1,363,076 | 12/1920 | Ajello | 36/30 R |
| 1,659,339 | 2/1928 | Vetterling | 36/28 |
| 1,693,911 | 12/1928 | Schmeer | 36/28 |
| 1,704,187 | 3/1929 | Glidden et al. | 36/30 R |
| 1,935,519 | 11/1933 | Quinn | 36/32 R |
| 2,724,912 | 11/1955 | Silombra | 36/30 R |
| 3,172,217 | 3/1965 | Colman | 36/28 |
| 3,273,265 | 9/1966 | Reinert | 36/30 R |

FOREIGN PATENT DOCUMENTS

| | | | |
|---|---|---|---|
| 2114869 | 9/1983 | United Kingdom | 36/114 |

*Primary Examiner*—Werner H. Schroeder
*Assistant Examiner*—Mary A. Ellis
*Attorney, Agent, or Firm*—Fleit, Jacobson, Cohn & Price

[57] ABSTRACT

A midsole assembly for an athletic shoe in which a corrugated sheet is integrally arranged in the midsole thereof. The corrugated sheet provides a proper stiffness of the midsole made of rubber or expandable synthetic resin as well as a proper cushioning property thereof and therefore provides a comfortable feeling when worn, best suited to each athletic activity.

8 Claims, 6 Drawing Figures

MIDSOLE ASSEMBLY FOR AN ATHLETIC SHOE

This invention relates to an improvement of a midsole assembly of shoes suitable for a wide range of athletic training and running activities.

When shoes are used for training in many fields of athletics, they are usually subjected to repeated shocks and impacts from contact with the ground and the shock is transmitted through the foot, knee and upper body of the wearer, and to his head. In such a case, if the ground is a paved surface, the shock from the contact with the ground is greater and, therefore, the wearer is likely to get blisters or swellings on the sole of the foot and his leg, knee and back may be injured in the worst cases.

At faster running speeds, the distribution of the force on the midsole varies greatly in the longitudinal and lateral directions and such tendency is greatly increased when running on an uneven surface. The uneven distribution of the force acting on the midsole from the ground contact causes uneven deflection of the midsole which can lead to injury of the leg, knee and back of the wearer.

In order to prevent these disadvantages of the athletic shoe, it is well known to form a thick midsole from a number of kinds of cushioning material. However, if the midsole is made too thick, it becomes too soft and is liable to become too deformable. This greatly reduces running stability and kicking force and can cause sprains to the wearer's ankles in addition to the above-mentioned problems.

Thus, it has been desired to develop an athletic shoe providing a moderate shock absorbing performance, stability in running and safety for the wearer.

It is an object of the present invention to provide a midsole of an athletic shoe satisfying the abovementioned requirements.

It is an another object of the present invention to provide a midsole assembly of an athletic shoe providing a high flexibility of design for an athletic shoe.

Further objects and advantages of the present invention will become apparent from the following description taken in conjunction with the accompanying drawings in which.

Figure 1:
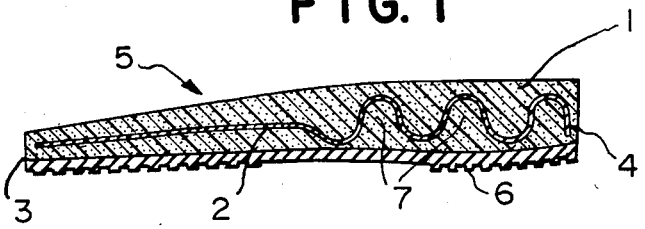
FIGS. 1 through 5 are cross-sectional views of five embodiments of the midsole assembly of the present invention.
Figure 2:
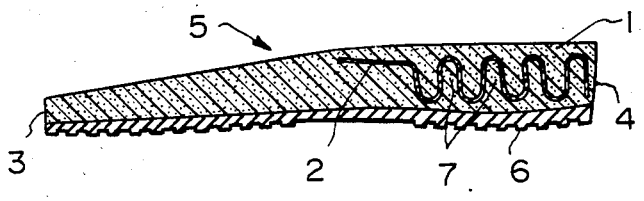
Figure 3:
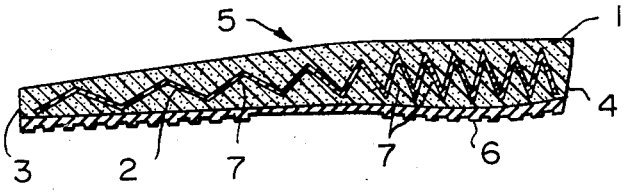
Figure 4:
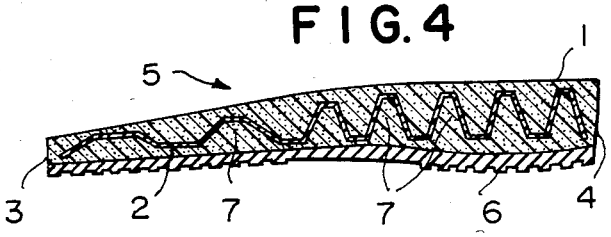
Figure 5:
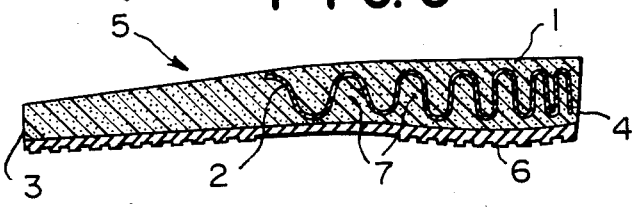

As clearly shown in the embodiments of FIGS. 1 through 5, the midsole assembly 5 of the present invention has a midsole 1 formed in desired thickness which is made of rubber, expandable polyurethane etc. having a moderate hardness and elasticity. A sheet 2 is made by any one of a woven fabric, a knitted fabric or a nonwoven fabric formed, for example, by cotton or nylon having a higher modulus of longitudinal elasticity (Young's modulus) than that of the midsole 1 and is located in the middle of the midsole 1. Young's modulus is a ratio of a simple tension stress applied to a material to the resulting strain parallel to the tension. In the present invention, the higher Young's modulus of sheet 2 indicates that the sheet 2 stretches less than the midsole 1. The sheet 2 has a corrugated configuration in longitudinal cross-section and is integrally formed with the midsole 1. A plurality of spaced walls 7 are formed between the corrugation waves of the sheet 2.

An outersole 6 is adhered to the under surface of the midsole 1 in the usual manner. It is preferable to provide the sheet 2 in the midsole 1 so as to cover the whole width of the midsole 1. The sheet 2 may be provided to extend either over the full length of the midsole 1 or only over the heel region 4. The pitch and the height of the corrugation of the sheet 2 can be properly determined in accordance with the use of the athletic shoes. However, it is preferable to make the height of the corrugation in the heel region 4 larger than that in the toe region 3.

Figure 6:
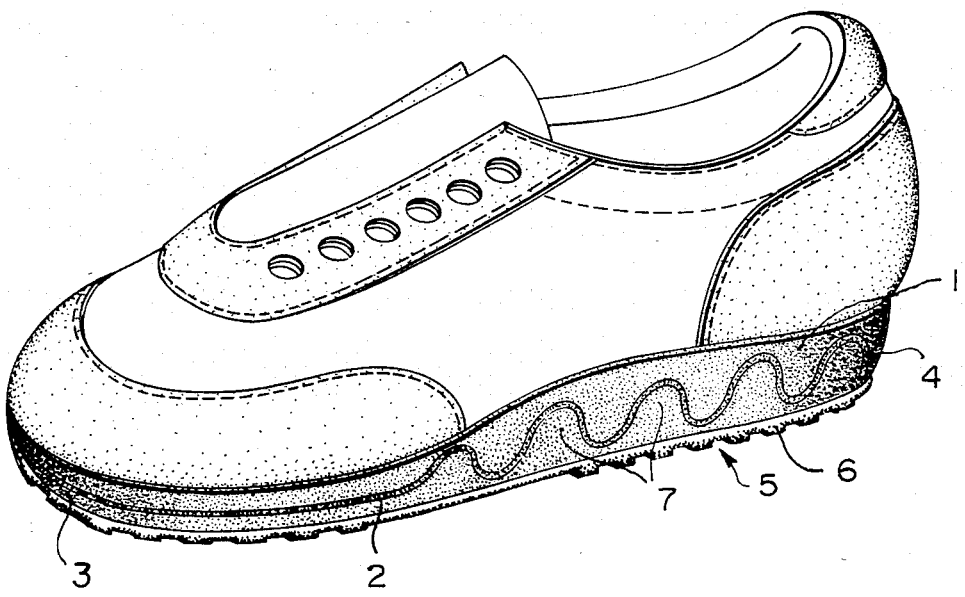
FIG. 6 is a perspective view of an athletic shoe having the midsole assembly of the present invention shown in FIG. 1.

When the athletic shoe having the midsole assembly 5 of the present invention, for example, that of FIG. 6, is subjected to a shock from the ground, the sheet 2 is compressed simultaneously with the compression of the midsole 1. The degree of compression of the midsole assembly 5 is adjustable by properly determining the pitch and the height of the corrugation of the sheet 2 and thus, excessive compression of the midsole 1 is prevented.

Making the pitch of the corrugation of the sheet 2 smaller and the height thereof higher increases the stiffness of the midsole 1 while, making the pitch larger and the height lower decreases the stiffness of the midsole 1 and softens it. Thus, provision of the sheet 2 in the midsole 1 will decrease the deflection of the midsole 1 and thus improve its fatigue resisting performance.

According to the present invention, it is possible to partially vary the cushioning property of the midsole 1 from the toe region 3 to the heel region 4 thereof by properly changing the pitch and the height of the corrugation of the sheet 2. Thus, a better fit between the wearer's foot and the athletic shoe is provided and also the shock repeatedly produced by contact with the ground is moderated. This greatly reduces the physical fatigue of the wearer and prevents blistering or swelling of the sole of his foot as well as injury of his leg, knee and back.

Furthermore, since the corrugated sheet 2 provided in the midsole 1 has superior adaptability for the longitudinal deflection of the midsole 1, a comfortable feeling is maintained over a long period of running without reducing the flexibility of the motion of the wearer's foot.

Also, according to the present invention, the sheet 2 has a corrugation in longitudinal direction and therefore, this increases the bending stiffness in lateral direction of the sheet 2. Thus, the lateral deformation of the midsole assembly 5 is moderately controlled by the provision of the corrugated sheet 2 in the midsole 1. This improves the stability in running and thus prevents the wearer from suffering the injuries or sprain and also increases the kicking force.

As stated above, since it is possible according to the present invention to properly change the cushioning property of the midsole 1 in both the toe region 3 and the heel region 4 without changing the material and the thickness of the midsole 1, a wide variety of design in athletic shoe is easily attainable in accordance with the use thereof.

What is claimed is:

1. A midsole assembly for an athletic shoe, said midsole assembly comprising a midsole including a toe region and a heel region, a sheet having a higher modulus of longitudinal elasticity than that of the midsole, said sheet being integrally arranged in the midsole and said sheet being in a corrugated form in the longitudinal cross-section of the midsole assembly, and a height of the corrugation of said sheet located in the heel region being larger than a height of the corrugation of said sheet located in the toe region for preventing excessive compression of said midsole.

2. A midsole assembly of claim 1, wherein said sheet is made by a woven fabric.

3. A midsole assembly of claim 1, wherein said sheet is made by a knitted fabric.

4. A midsole assembly of claim, wherein said sheet is made by a nonwoven fabric.

5. A midsole assembly for an athletic shoe, said midsole assembly comprising a midsole including a toe region and a heel region, and a sheet having a higher modulus of longitudinal elasticity than that of the midsole, said sheet being integrally arranged in the midsole and said sheet being in a flat form in the toe region and a corrugated form in the heel region in the longitudinal cross-section thereof for preventing excessive compression of said midsole.

6. A midsole assembly of claim 5, wherein said sheet is made by a woven fabric.

7. A midsole assembly of claim 5, wherein said sheet is made by a knitted fabric.

8. A midsole assembly of claim 5, wherein said sheet is made by a nonwoven fabric.

* * * * *